US010335805B2

(12) United States Patent
Barenhoff et al.

(10) Patent No.: US 10,335,805 B2
(45) Date of Patent: Jul. 2, 2019

(54) NOZZLE ARRANGEMENT AND DISPENSING HEAD

(71) Applicant: APTAR DORTMUND GMBH, Dortmund (DE)

(72) Inventors: Swen Barenhoff, Boenen (DE); Detlef Schmitz, Luedinghausen (DE)

(73) Assignee: APTAR DORTMUND GMBH, Dortmund (DE)

( * ) Notice: Subject to any disclaimer, the term of this patent is extended or adjusted under 35 U.S.C. 154(b) by 0 days.

(21) Appl. No.: 15/576,412

(22) PCT Filed: Jul. 12, 2016

(86) PCT No.: PCT/EP2016/025075
§ 371 (c)(1),
(2) Date: Nov. 22, 2017

(87) PCT Pub. No.: WO2017/012717
PCT Pub. Date: Jan. 26, 2017

(65) Prior Publication Data

US 2018/0154376 A1 Jun. 7, 2018

(30) Foreign Application Priority Data

Jul. 20, 2015 (DE) ..... 10 2015 009 303
Oct. 19, 2015 (DE) ..... 10 2015 013 414

(51) Int. Cl.
*B05B 1/04* (2006.01)
*B05B 1/34* (2006.01)
(Continued)

(52) U.S. Cl.
CPC ..... *B05B 1/048* (2013.01); *B05B 1/3405* (2013.01); *B05B 1/3436* (2013.01); *B05B 15/30* (2018.02);
(Continued)

(58) Field of Classification Search
CPC ..... B65D 83/20; B65D 83/14; B65D 83/48; B65D 83/753; B05B 1/048; B05B 15/30; B05B 1/3405; B05B 1/3436
(Continued)

(56) References Cited

U.S. PATENT DOCUMENTS 3,054,563 A * 9/1962 Steinen ..... B05B 1/042 239/492
4,097,000 A 6/1978 Derr
(Continued)

FOREIGN PATENT DOCUMENTS

BE 655055 A 2/1965
CN 201603650 U 10/2010
(Continued)

OTHER PUBLICATIONS

International Preliminary Report on Patentability for International Application No. PCT/EP2016/025075, dated Jan. 23, 2018.
(Continued)

*Primary Examiner* — Steven J Ganey
(74) *Attorney, Agent, or Firm* — Jason H. Vick; Sheridan Ross, PC

(57) ABSTRACT

A nozzle arrangement for the preferably fan-like atomization of a fluid, particularly oil, a dispensing head with such a nozzle arrangement, and the use of such a nozzle arrangement for the particularly fan-like atomization of a fluid, particularly of an oil, is proposed, wherein a channel of the nozzle arrangement has a first channel portion and a second channel portion that connects to the first channel portion in the direction of flow of the fluid, wherein the first channel portion converges in the direction of flow of the fluid, wherein the second channel portion is elongate and/or slot-like in cross section and bordered by two elongate side surfaces and two short leg surfaces, wherein the leg surfaces
(Continued)

are inclined relative to the direction of flow and/or a longitudinal axis of the channel, and/or wherein the second channel portion is embodied as a trapezoidal prism and the side surfaces are arranged so as to be at least substantially parallel to one another.

17 Claims, 6 Drawing Sheets

(51) Int. Cl.
*B65D 83/48* (2006.01)
*B65D 83/14* (2006.01)
*B65D 83/20* (2006.01)
*B05B 15/30* (2018.01)

(52) U.S. Cl.
CPC ..... *B65D 83/14* (2013.01); *B65D 83/20* (2013.01); *B65D 83/48* (2013.01); *B65D 83/753* (2013.01)

(58) Field of Classification Search
USPC ..... 239/337, 490–493, 597–599
See application file for complete search history.

(56) References Cited

U.S. PATENT DOCUMENTS

| | | | | |
|---|---|---|---|---|
| 4,905,911 | A | 3/1990 | Sakuma | |
| 6,345,775 | B1 * | 2/2002 | Purvis, II | B05B 1/042 239/337 |
| 7,648,087 | B2 | 1/2010 | Horn et al. | |
| 2005/0045741 | A1 | 3/2005 | Brown | |

FOREIGN PATENT DOCUMENTS

| | | | |
|---|---|---|---|
| EP | 1886731 | B1 | 1/2012 |
| JP | H04-122658 | U | 11/1992 |
| WO | WO 00/55543 | | 9/2000 |
| WO | WO 2008/008588 | | 1/2008 |

OTHER PUBLICATIONS

International Search Report for International Application No. PCT/EP2016/025075, dated Jan. 3, 2017.
Written Opinion for International Application No. PCT/EP2016/025075, dated Jan. 3, 2017.

* cited by examiner

NOZZLE ARRANGEMENT AND DISPENSING HEAD

CROSS REFERENCE TO RELATED APPLICATIONS

This application is a national stage application under 35 U.S.C. 371 of PCT Application No. PCT/EP2016/025075 having an international filing date of 12 Jul. 2016 which designated the United States, which PCT application claimed the benefit of German Application No. 10 2015 009 303.7 filed 22 Jul. 2015 and German Application No. 10 2015 013 414.0 filed 19 Oct. 2015, each of which are incorporated herein by reference in their entirety.

The present invention relates to a nozzle arrangement for the preferably fan-like atomization of a fluid, particularly oil, according to the preamble of claim 1, a dispensing head for delivering a fluid, particularly oil, according to the preamble of claim 10, and the use of a nozzle arrangement for the preferably fan-like atomization of a fluid, particularly oil, according to claim 11.

The term "dispensing head" is preferably to be understood as a structural device that is designed particularly for the purpose of delivering, particularly atomizing or converting to an aerosol, a fluid, particularly an oil, such as olive oil. A dispensing head is or can be preferably mounted on a container as a reservoir for a fluid to be atomized. Especially preferably, the dispensing head is designed to deliver or dispense a fluid, particularly oil, in spray form. However, the dispensing head can also be embodied as a dosing pump or manually operated pump or any other dispensing device.

The term "fluid" is to be understood preferably as liquids, suspensions, and/or emulsions, optionally with gas phases. In particular, fluids in terms of the present invention are vinegars and/or oils that are preferably suitable for consumption—as dressing, for example. However, the term "fluid" is to be preferably understood and interpreted in a broad sense.

The term "nozzle arrangement" is to be understood preferably as a structural device, particularly of a dispensing head, particularly with the nozzle arrangement being designed for the purpose of atomizing a fluid, preferably in the manner of a fan. A nozzle arrangement in terms of the present invention preferably has at least one channel or flow channel for the fluid, with the nozzle arrangement and/or channel being preferably embodied such that the fluid can be atomized or converted to an aerosol.

In the present invention, the term "aerosol" is to be understood preferably as a cloud-like or fog-like collection of a plurality of drops of a fluid that is preferably atomized by means of a dispensing head and/or a nozzle arrangement, with the drops preferably traveling at a low speed and/or in directions of motion that are at least substantially undirected. An "aerosol" can have or form a flat, cone-shaped and/or fan-like cloud of droplets, for example, with the main direction of propagation and/or direction of flow of the droplet cloud particularly corresponding at least substantially to the main discharge direction and/or discharge impulse direction from the dispensing head and/or nozzle arrangement.

EP 1 886 731 B1 discloses a spray nozzle arrangement for spraying a medium using a nozzle channel, with the nozzle channel having a first tapering channel portion and a second channel portion, with the first channel portion being fluidically connected via a passage opening to the second channel portion. The second channel portion has two opposing side surfaces whose distance from one another increases in the direction away from the passage opening, with the side surfaces being bordered by two boundary surfaces arranged perpendicular to the plane of the passage opening and spaced apart laterally from the passage opening.

It is the object of the present invention to provide an improved nozzle arrangement as well as a dispensing head with an improved nozzle arrangement, preferably wherein an especially efficient dispensing and/or atomization of a fluid, particularly an oil, and/or the simple mounting of the nozzle arrangement is enabled or supported, and/or a uniform, preferably fan-like spray pattern is produced.

The above object is achieved by a nozzle arrangement according to claim 1, a dispensing head according to claim 10, or a use of a nozzle arrangement according to claim 11. Advantageous developments constitute the subject matter of the subclaims.

The nozzle arrangement according to the invention preferably has a channel for a fluid, with the channel preferably having a first channel portion and a second channel portion that connects to the first channel portion in the direction of flow of the fluid. The first and second channel portions are preferably fluidically interconnected by means of a passage opening.

Preferably, the first channel portion converges in the direction of flow of the fluid and/or the flow cross section of the first channel portion decreases in the direction of flow of the fluid. Especially preferably, the first channel portion tapers in the direction of flow of the fluid to a gap or slot.

Preferably, the second channel portion is elongate and/or slot-like in cross section and/or transverse to the direction of flow of the fluid and bordered by two elongate side surfaces and two short leg surfaces, with the second channel portion in particular diverging in the direction of flow.

One aspect of the present invention is that the leg surfaces of the second channel portion are arranged so as to be inclined or sloped relative to the direction of flow and/or to a longitudinal axis of the channel. In this way, a very uniform spray pattern is produced that is at least substantially independent of the pressure and/or speed of the fluid and/or is fan-like even if the pressure or speed of the fluid decreases.

The direction of flow of the fluid is preferably the direction that corresponds to the main direction of propagation of the fluid in the channel of the nozzle arrangement. Any possible turbulence and/or vortexing of the fluid can deviate from the direction of flow or main direction of propagation; in particular, it can run counter to the direction of flow or main direction of propagation of the fluid.

According to another aspect of the present invention that can also be realized independently, the second channel portion is embodied as a trapezoidal prism, with the side surfaces being preferably arranged at least substantially parallel to one another and/or embodied as a bottom surface of the trapezoidal prism. Corresponding advantages can be achieved in this way. In particular, any possible flow losses in the channel are reduced.

Preferably, the dispensing head and/or nozzle arrangement is designed for the purpose of producing a fan-like and/or elongate spray pattern and/or a fan-like and/or flat spray cloud, with the droplet concentration preferably decreasing toward the sides starting from the center of the spray pattern.

The dispensing head according to the invention for dispensing a fluid, particularly oil, has a housing part, an actuation part for actuating the dispensing head, and a nozzle arrangement according to the invention for the preferably fan-like atomization of the fluid, with the dispensing head preferably being connectable to an associated container, particularly a pressurized container, with the fluid. Corresponding advantages can be achieved in this way.

According to another aspect of the present invention that can also be realized independently, the particularly cylindrical nozzle arrangement has—preferably on the front side—a mounting profile and/or mounting element, such as a projection and/or a depression, with the nozzle arrangement preferably being connectable in a form-fitting manner during or for mounting via the mounting profile and/or mounting element to an associated mounting device and/or alignable in its rotational position relative to the housing part and/or actuating part by means of the mounting profile and/or mounting element.

In particular, the nozzle arrangement can be coupled in a form-fitting manner with a mounting device—preferably on the front side and/or axially—in order to set a desired rotational position of the nozzle arrangement. In this way, the simple mounting and/or precise alignment of the nozzle arrangement is enabled or supported.

The inventive use makes a provision to use a nozzle arrangement according to the invention for the particularly fan-like atomization of a fluid, particularly oil. Corresponding advantages can be achieved in this way.

Additional aspects, features, characteristics, and advantages of the present invention follow from the claims and the following description of preferred embodiments with reference to the drawing.

In the partially not-to-scale, merely schematic figures, the same reference symbols are used for same or similar parts, with corresponding or comparable characteristics and advantages being achieved even if a repeated description is omitted.

FIG. 1 shows a proposed dispensing device 1 according to a first embodiment in a schematic longitudinal section.

Figure 1:
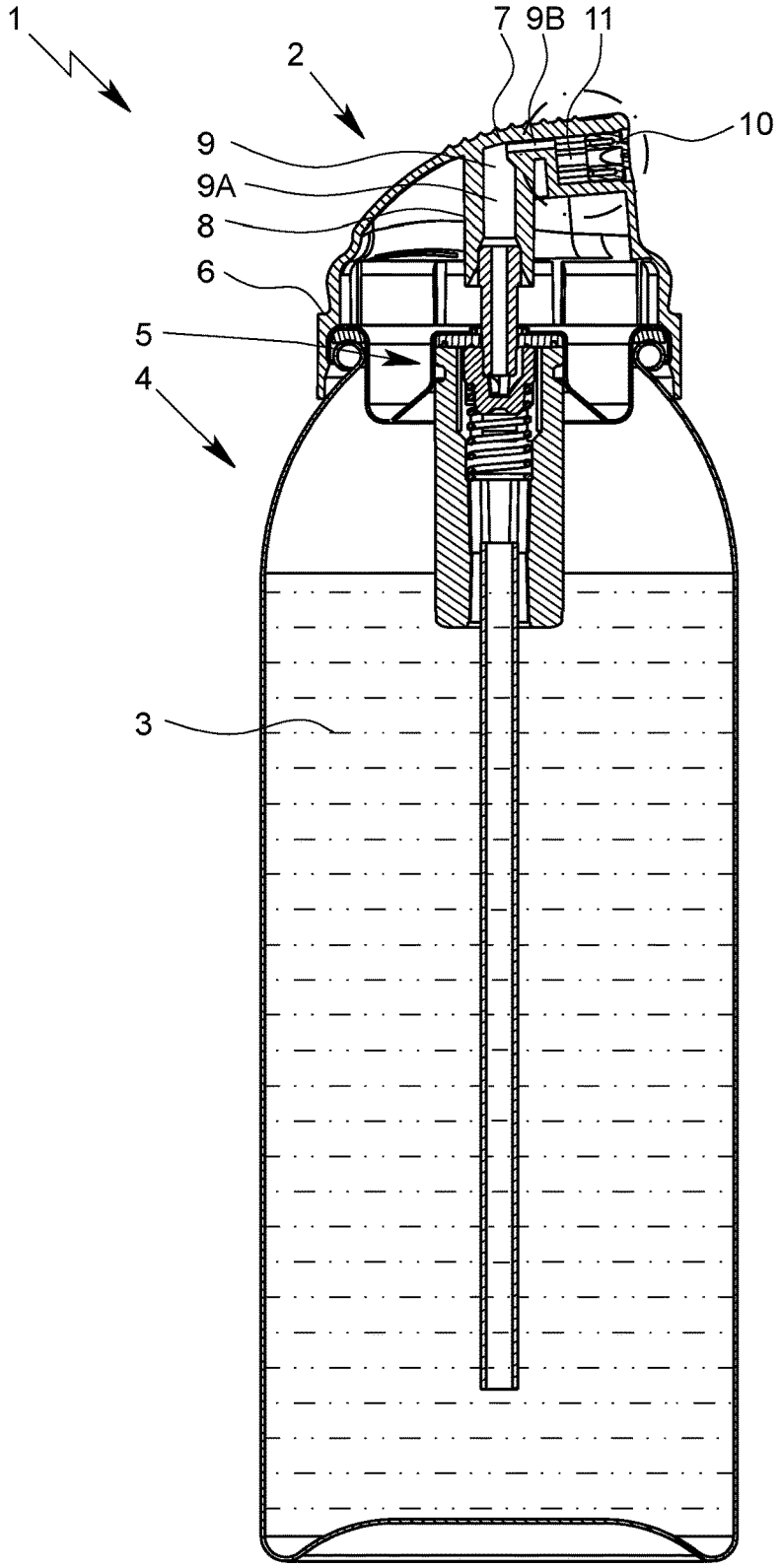
FIG. 1 shows a schematic longitudinal section of a dispensing device with a proposed dispensing head and with a proposed nozzle arrangement according to a first embodiment.

The dispensing device 1 preferably has a dispensing head 2 for dispensing a fluid 3.

Preferably, the dispensing device 1 and/or dispensing head 2 is designed to dispense the fluid 3 in the form of a spray. Especially preferably, the dispensing device 1 and/or dispensing head 2 is designed for the purpose of atomizing the fluid 3 and/or forming an aerosol.

The dispensing device 1 and/or dispensing head 2 is preferably provided with or is or can be connected to a reservoir, particularly a container 4, for the fluid 3.

The reservoir or container 4 is particularly part of the dispensing device 1 and/or is connected or connectable to the dispensing head 2.

In the depicted example, the reservoir is preferably embodied as a rigid container 4, particularly as a pressurized container. The container 4 is preferably elongate, cylindrical and/or rigid—and is especially preferably embodied as a metallic can or glass container.

The fluid 3 in the reservoir can be preferably pressurized or is pressurized. Preferably, the container 4 or the fluid 3 contains a suitable propellant, preferably a volatile and/or flammable propellant, compressed gas, and/or carbon dioxide. However, the dispensing device 1 and/or dispensing head 2 can also have or form a pump (not shown) or the like that sucks or pumps the fluid 3 out of the container 4.

The container 4 preferably has a dispensing valve 5, especially preferably on the front side.

Preferably, the dispensing head 2 is (fluidically) connected or connectable to the dispensing valve 5.

The dispensing head 2 preferably has a housing part 6 that is or can be preferably connected to the reservoir or container 4 in a form-fitting, force-fitting, and/or bonded manner. In the depicted example, the dispensing head 2 is preferably fastened to the container in a clamping and/or locking manner.

Preferably, the dispensing head 2 has an actuation part 7 that can be preferably depressed or tilted or swiveled relative to the housing part 6—downward in the illustration according to FIG. 1.

Preferably, the actuation part 7 is connected to the housing part 6 by means of a particularly elastically deformable connection. The housing part 6 and the actuation part 7 are especially preferably integrally formed and/or formed as a structural unit. However, other structural solutions are also possible here.

The actuation part 7 preferably extends at least substantially—at least in the usual operating position—horizontally and/or, starting from an edge of the housing part 6, toward the center and/or over the dispensing valve 5.

Especially preferably, the actuation part 7 forms an (axial) end of the dispensing device 1 and/or dispensing head 2.

The dispensing head 2 and/or actuation part 7 preferably has a connecting portion 8, with the connecting portion 8 preferably extending toward the dispensing valve 5 and/or being fluidically connected or connectable to the dispensing valve 5.

Especially preferably, the connecting portion 8 can be moved and/or depressed accordingly by actuating or depressing the dispensing head 2 or actuation part 7, particularly in the direction of the dispensing valve 5, preferably in order to actuate or open the associated and/or fluidically connected dispensing valve 5. FIG. 1 shows the non-actuated state of the dispensing device 1.

The dispensing device 1 and/or dispensing head 2 preferably has an outlet compartment 9, with the outlet compartment 9 being preferably used to receive the fluid 3 that is dispensed by the dispensing valve 5 or flows out of the container 4 upon actuation of the dispensing device 1 and/or dispensing head 2.

Preferably, the outlet compartment 9 is formed and/or laterally bordered by the actuation part 7, particularly the connecting portion 8.

Preferably, the outlet compartment 9 has a conveying channel 9A and/or a connecting channel 9B.

The conveying channel 9A is preferably formed in and/or by the connecting portion 8 and/or extends at least substantially vertically in the usual operating position.

The connecting channel 9B preferably extends at least substantially transversely to the conveying channel 9A and/or substantially horizontally in the usual operating position.

The dispensing device 1 and/or dispensing head 2 preferably has a nozzle arrangement 10.

The nozzle arrangement 10 is preferably embodied as a particularly exchangeable nozzle insert for the dispensing device 1 and/or dispensing head 2.

Preferably, the nozzle arrangement 10 is connected or connectable in a form-fitting, force-fitting, and/or bonded manner to the housing part 6 and/or actuation part 7.

Especially preferably, the dispensing device 1 and/or dispensing head 2 has a receptacle 11 for the nozzle arrangement 10 that can be or is preferably inserted and/or clamped and/or plugged at least partially, preferably completely, into the receptacle 11.

The receptacle 11 is preferably formed by the housing part 6 and/or actuation part 7 or integrated therein.

Preferably, the outlet compartment 9 is fluidically connected or connectable to the receptacle 11 and/or the nozzle arrangement 10. In particular, the connecting channel 9B connects the conveying channel 9A to the receptacle 11 and/or nozzle arrangement 10.

The conveying channel 9A is preferably wider and/or longer than the connecting channel 9B.

Preferably, the width or diameter of the receptacle 11 is larger than the conveying channel 9A and/or the connecting channel 9B.

The dispensing head 2, particularly the housing part 6 and/or actuation part 7 and/or the nozzle arrangement 10, is or are preferably injection-molded and/or made of plastic.

The nozzle arrangement 10 preferably forms an assembly or a component that is or can be inserted particularly in prefabricated form, preferably into the receptacle 11. Especially preferably, the nozzle arrangement 10 can be or is received or held in a locking or clamping manner by the receptacle 11.

Preferably, the nozzle arrangement 10 leads immediately or directly "into the open". In particular, no additional component connects to the nozzle arrangement 10 in the direction of flow S of the fluid 3.

Figure 2:
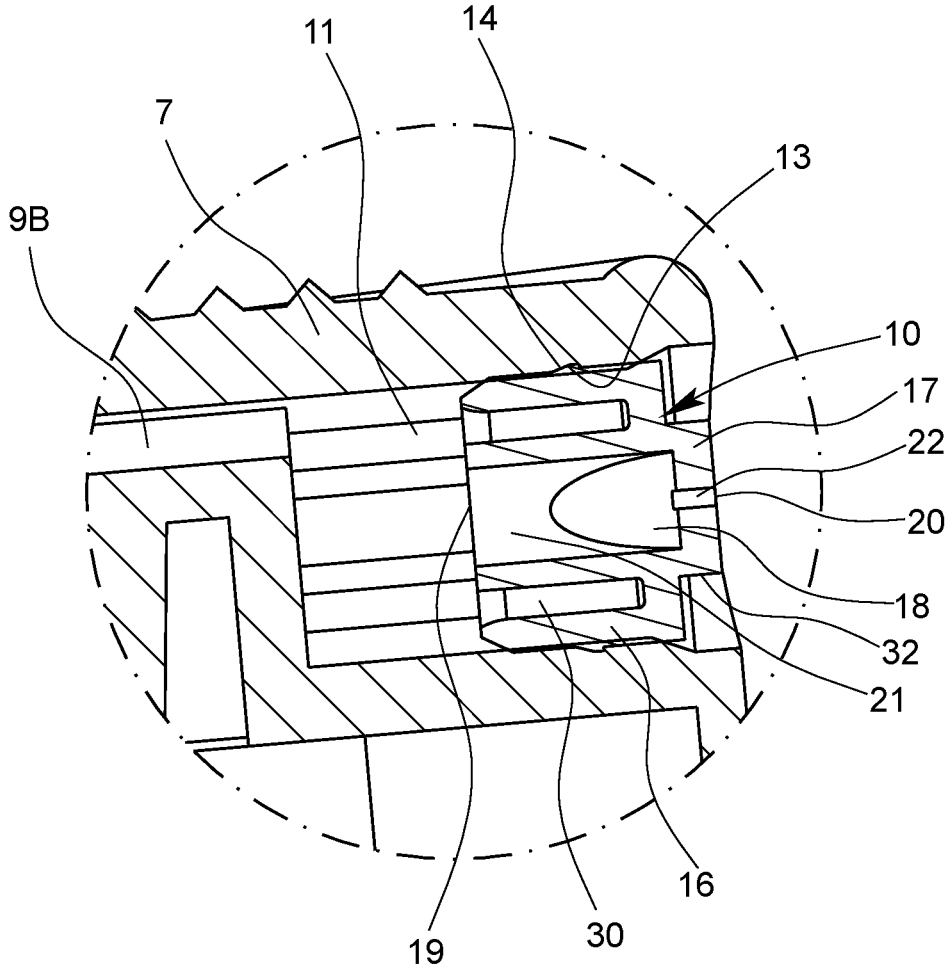
FIG. 2 shows an enlarged representation of the nozzle arrangement in the dispensing head according to FIG. 1.

FIG. 2 shows enlarged details of the dispensing head 2 with the proposed nozzle arrangement 10.

Preferably, the nozzle arrangement 10 is or can be received or held completely by the dispensing head 2, particularly the receptacle 11. Especially preferably, the receptacle 11 is deep and/or long enough that the nozzle arrangement 10 can be or is inserted or recessed completely into the receptacle 11.

Especially preferably, the nozzle arrangement 10 discharges in a common plane with the housing part 6 and/or actuation part 7. Other solutions are also possible, however, particularly ones in which the nozzle arrangement 10 projects outward and/or over the edge of the housing part 6 and/or actuation part 7.

FIGS. 3 to 9 show various views of the proposed nozzle arrangement 10 according to the first embodiment.

The nozzle arrangement 10 is preferably at least substantially cylindrical and/or embodied as a cylindrical body or cylinder. Especially preferably, the outer surface 12 of the nozzle arrangement 10 is embodied as a lateral surface (of a cylinder). Other solutions are also possible here, however. In particular, the nozzle arrangement 10 can also be embodied as a prism or the like.

The nozzle arrangement 10 preferably has a width or diameter of greater than 2 mm, especially preferably greater than 3 mm, particularly greater than 4 mm, and/or less than 10 mm, especially preferably less than 8 mm or 6 mm, particularly less than 5 mm.

The nozzle arrangement 10 preferably has a height or length of greater than 2 mm, especially preferably greater than 3 mm, and/or less than 10 mm or 8 mm, especially preferably less than 7 mm or 6 mm, particularly less than 5 mm.

Preferably, the nozzle arrangement 10, particularly the outer surface 12, has a preferably circumferential projection 13. Alternatively or in addition, the nozzle arrangement 10, particularly the outer surface 12, preferably has a particularly circumferential depression (not shown).

Preferably, the dispensing head 2, particularly the receptacle 11, has a recess 14 and/or raised area (not shown) that is complementary to the projection 13 and/or depression.

In particular, the nozzle arrangement 10 is or can be connected in a form-fitting and/or force-fitting manner to the housing part 6 and/or actuation part 7, particularly the receptacle 11, particularly through engagement of the projection 13 in the recess 14. Other solutions are also possible here, however.

Preferably, the nozzle arrangement 10 is or can be connected—particularly by means of the projection 13—in such a way to the housing part 6 and/or actuation part 7 that it is or can be fixed in its rotational position, preferably in the receptacle 11, particularly in a form-fitting and/or force-fitting manner.

The nozzle arrangement 10 is preferably stepped or preferably has at least one step 15. In the depicted embodiment, two oppositely situated steps 15 are preferably formed by two lateral recesses.

Preferably, the nozzle arrangement 10 has a base part 16 and a top part 17.

Preferably, the base part 16 and/or the top part 17 is or are at least substantially cylindrical and/or embodied as a cylinder.

Preferably, the top part 17 is shallower and/or narrower than the base part 16. In particular, the width or the diameter of the top part 17 is at least partially smaller than the width or the diameter of the base part 16. In this way, easy handling and/or mounting of the nozzle arrangement 10 is enabled or supported.

It is very especially preferred for the top part 17 to be embodied at least substantially as a cuboid or to be cuboid-like, with two sides of the top part 17 being preferably curved and/or lying on the outer surface 12 of the base part 16.

The nozzle arrangement 10 preferably has a channel or flow channel 18, with the channel or flow channel 18 running particularly in the center, on the interior, and/or along a spraying or longitudinal axis L of the nozzle arrangement 10.

The channel 18 preferably extends both through the base part 16 and through the top part 17.

The nozzle arrangement 10 and/or the channel 18 preferably has an inlet opening 19 and an outlet opening 20. In particular, the channel 18 forms an inlet opening 19 and/or outlet opening 20, with the inlet opening 19 preferably being arranged on the bottom side or in the base part 16 and the outlet opening 20 being arranged on the top side or in the top part 17.

Preferably, the inlet opening 19 is at least substantially circular and/or the outlet opening 20 is at least substantially elongate or slot-like, as will be explained below in greater detail.

Upon actuation of the dispensing device 1 and/or dispensing head 2, the fluid 3 preferably passes first through the inlet opening 19 and/or the base part 16 and then through the outlet opening 20 and/or the top part 17.

The channel 18 is preferably subdivided into at least two portions. Especially preferably, the channel 18 has a first channel portion 21 and a second channel portion 22.

Preferably, the first channel portion 21 is fluidically connected to the second channel portion 22, preferably via a passage opening 23.

Preferably, the second channel portion 22 connects to the first channel portion 21 in the direction of flow S of the fluid 3 and/or, upon actuation of the dispensing device 1 and/or dispensing head 2, the fluid 3 flows first through the first channel portion 21 and then through the second channel portion 22.

The first channel portion 21 is preferably longer than the second channel portion 22. Other solutions are also possible here, however.

Preferably, the first channel portion 22 has a length of greater than 1 mm, especially preferably greater than 2 mm, particularly greater than 3 mm, and/or less than 10 mm or 8 mm, especially preferably less than 7 mm or 6 mm, particularly less than 5 mm or 4 mm.

Preferably, the second channel portion 22 has a length of greater than 0.1 mm, especially preferably greater than 0.2 mm or 0.3 mm, particularly greater than 0.4 mm or 0.5 mm, and/or less than 2 mm or 1.5 mm, especially preferably less than 1.2 mm or 1 mm, particularly less than 0.9 mm or 0.8 mm.

Preferably, the first channel portion 21 is arranged—at least substantially in its entirety—in the base part 16 of the nozzle arrangement 10.

Preferably, the second channel portion 22 is arranged—at least substantially in its entirety—in the top part 17 of the nozzle arrangement 10.

The first channel portion 21 preferably has and/or forms the inlet opening 19.

The first channel portion 21 tapers preferably in the direction of flow S of the fluid 3 and/or converges in the direction of flow S of the fluid 3.

Preferably, the channel portion 21 has an internal or flow cross section Q that decreases in the direction of flow S, with the flow cross section Q being preferably constant at first and subsequently decreasing.

The internal or flow cross section Q is preferably an internal or flow cross-sectional surface perpendicular to the longitudinal axis L or direction of flow S of the channel 18 or a hydraulic cross section or hydraulic cross-sectional surface. In particular, the internal or flow cross section Q is the surface that is bordered or enclosed by a side wall of the channel 18, particularly of the first channel portion 21 and/or of the second channel portion 22.

Especially preferably, the first channel portion 21 tapers in the direction of flow S of the fluid 3 in the manner of a slot and/or to an elongate or slot-like flow cross section Q.

In particular, the smallest flow cross section Q of the first channel portion 21 is at least substantially slot-like and/or rectangular.

Preferably, the first channel portion 21 has two side surfaces or side bevels 24 that are inclined relative to one another and/or relative to the direction of flow S or longitudinal axis L, with the side bevels 24 being preferably inclined such that the first channel portion 21 tapers in the manner of a slot or to an elongate or slot-like flow cross section Q.

Preferably, the side bevels 24 are each level or flat. Other solutions are also possible here, however, particularly in which the side bevels 24 are curved.

In an alternative embodiment (not shown), the first channel portion 21 is preferably conical and/or the first channel portion 21 tapers conically.

Preferably, the first channel portion 21 is designed, preferably tapered, such that a fluid 3 flowing into the nozzle arrangement 10 is compressed and/or accelerated in the first channel portion 21.

Preferably, the (maximum) width or the (maximum) diameter of the inlet opening 19 and/or of the largest flow cross section Q of the first channel portion 21 is greater than 1 mm, especially preferably greater than 1.2 mm, particularly greater than 1.4 mm, and/or less than 3 mm, especially preferably less than 2.5 mm, particularly less than 2 mm.

Preferably, the side bevels 24 of the first channel portion 21 are inclined by more than 5°, especially preferably more than 10°, particularly more than 15°, and/or less than 45°, especially preferably less than 30°, particularly less than 20°, relative to the direction of flow S and/or longitudinal axis L of the nozzle arrangement 10.

As already mentioned at the outset, the first channel portion 21 and the second channel portion 22 are preferably interconnected fluidically via a passage opening 23.

The passage opening 23 is preferably rectangular, particularly square, and/or has the smallest flow cross section S in the channel 18. Other solutions are also possible here, however, particularly in which the passage opening 23 is at least substantially circular or oval-shaped. Any possible flow losses can be reduced in this way.

The passage opening 23 is preferably smaller than the preferably slot-like flow cross section Q of the first channel portion 21 that is adjacent to the passage opening 23.

Especially preferably, the flow cross section Q decreases abruptly in the direction of flow S at the end of the first channel portion 21.

The second channel portion 22 is preferably elongate or slot-like in cross section.

Preferably, the second channel portion 22 leads directly into the open and/or to a front surface 25 of the nozzle arrangement 10 and/or of the top part 17.

Very especially preferably, the second channel portion 22 is embodied as an elongate recess or groove and/or is recessed into the nozzle arrangement 10, particularly the top part 17. This enables the nozzle arrangement 10 to be manufactured in an especially simple and/or cost-effective manner.

Preferably, the (maximum) longitudinal extension of the second channel portion 22 transverse to the longitudinal axis L or direction of flow S and/or the (maximum) length of the largest flow cross section Q of the second channel portion 22 and/or the (maximum) width or the (maximum) diameter of the outlet opening 20 is greater than the length and/or depth of the second channel portion 22 along the direction of flow S or longitudinal axis L. Other solutions are also possible here, however, particularly in which the second channel portion 22 is elongate and/or the (maximum) longitudinal extension of the second channel portion 22 transverse to the longitudinal axis L or direction of flow S is less than its length and/or depth along the direction of flow S.

The second channel portion 22 preferably has a length and/or depth along the direction of flow S or longitudinal axis L of greater than 0.1 mm or 0.2 mm, especially preferably greater than 0.3 mm or 0.4 mm, particularly greater than 0.5 mm or 0.6 mm, and/or less than 10 mm or 6 mm, especially preferably less than 5 mm or 3 mm, particularly less than 2 mm or 1 mm.

Preferably, the second channel portion 22 has or forms the outlet opening 20, with the outlet opening 20 being preferably arranged in the front surface 25 of the nozzle arrangement 10.

Preferably, the second channel portion 22 widens in the direction of flow S of the fluid 3 and/or the second channel portion 22 diverges in the direction of flow S of the fluid 3.

Preferably, the largest flow cross section Q of the second channel portion 22 corresponds to the outlet opening 20.

Preferably, the longitudinal extension or length of the largest flow cross section Q of the second channel portion 22 and/or the (maximum) width of the outlet opening 20 is greater than 1 mm, especially preferably greater than 1.5 mm, particularly greater than 2 mm, and/or less than 8 mm, especially preferably less than 6 mm or 4 mm, particularly less than 3.5 mm or 3 mm.

The second channel portion 22 preferably has two elongate side surfaces 26 and two short leg surfaces 27 and/or is bordered by two elongate side surfaces 26 and two short leg surfaces 27.

Preferably, the surface area of the side surfaces 26 corresponds to a multiple of the surface area of the leg surfaces 27, particularly at least to a multiple of 1.5 or 2 thereof.

Preferably, the side surfaces 26 of the second channel portion 22 run at least substantially parallel to one another and/or to the direction of flow S or the longitudinal axis L. Other solutions are also possible here, however, particularly in which the side surfaces 26 are inclined in relation to one another and/or to the direction of flow S or longitudinal axis L.

The leg surfaces 27 of the second channel portion 22 are preferably inclined relative to the direction of flow S or longitudinal axis L, preferably such that the flow cross section Q of the second channel portion 22 widens in the direction of flow S of the fluid 3—preferably in a continuous, constant and/or linear manner.

Preferably, the leg surfaces 27 are inclined such that the side surfaces 26 are (each) trapezoid-shaped and/or the second channel portion 22 is embodied as a trapezoidal prism.

Preferably, the side surfaces 26 and/or leg surfaces 27 are (each) flat. Particularly, the second channel portion 22 is stepless. Alternatively, the side surfaces 26 and/or leg surfaces 27 can be curved and/or bent.

Preferably, the leg surfaces 27 are each inclined by more than 10°, especially preferably more than 20°, particularly more than 30°, and/or less than 80° or 70°, especially preferably less than 60°, particularly less than 50°, relative to the direction of flow S or longitudinal axis L of the nozzle arrangement 10.

Very especially preferably, the leg surfaces 27 are to a greater extent inclined relative to the direction of flow S or longitudinal axis L than the side bevels 24 of the first channel portion 21 relative to the direction of flow S or longitudinal axis L. In this way, a slow compression and/or acceleration and a quick decompression and/or delaying of the fluid 3 in the channel 18 is enabled or supported, thus enabling good atomization to be achieved even under falling pressure and/or decreasing speed of the fluid 3.

Preferably, the side surfaces 26 and/or leg surfaces 27 are spaced apart from the passage opening 23 and/or the second channel portion 22 has a bottom surface 28, with the bottom surface 28 preferably connecting laterally to the passage opening 23 and being arranged between the passage opening 23 and the side surfaces 26 and/or leg surface 27.

Preferably, the bottom surface 28 is arranged so as to be at least substantially parallel to the front surface 25 of the nozzle arrangement 10 and/or transverse to the direction of flow S.

Preferably, the flow cross section Q widens abruptly in the direction of flow S starting from the passage opening 23.

Figure 3:
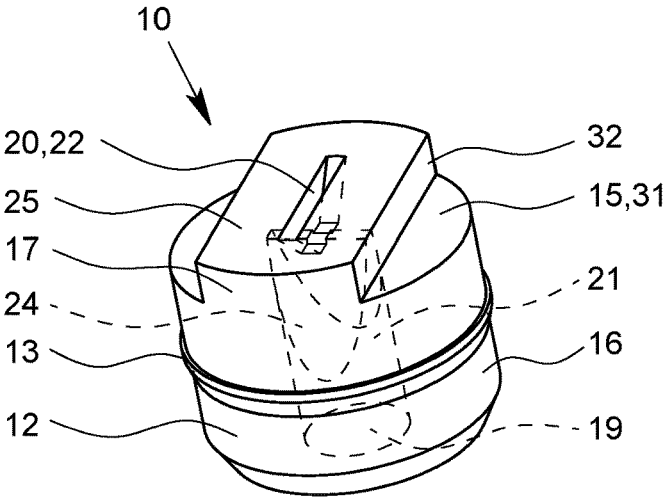
FIG. 3 shows a perspective view of the nozzle arrangement.
Figure 4:
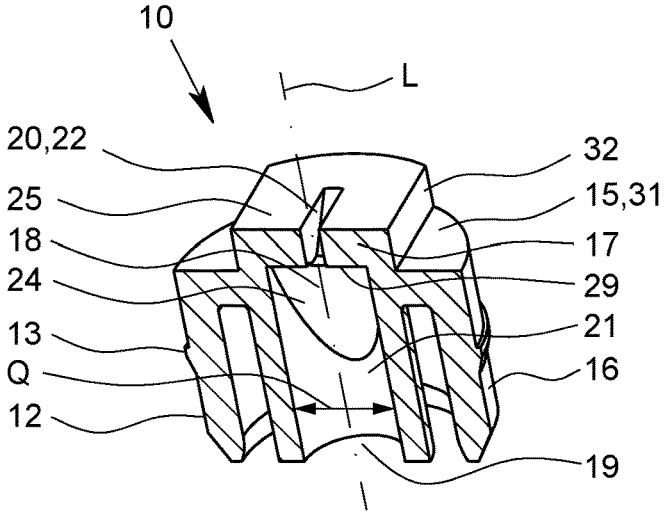
FIG. 4 shows a perspective view of the nozzle arrangement according to FIG. 3 in a longitudinal section.
Figure 5:
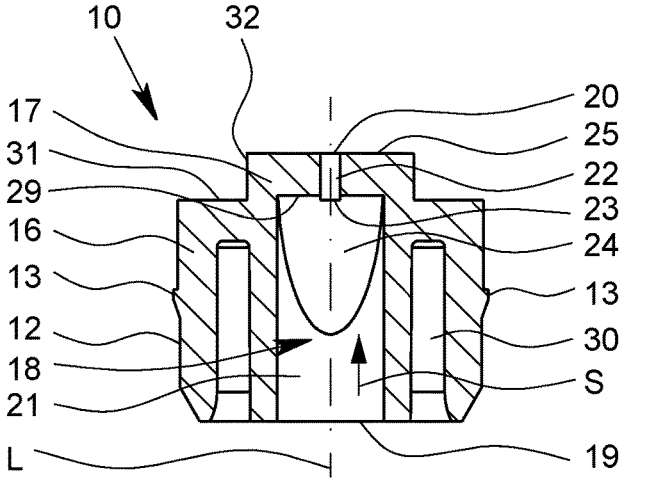
FIG. 5 shows a side view of the nozzle arrangement according to FIG. 3 in a longitudinal section.
Figure 6:
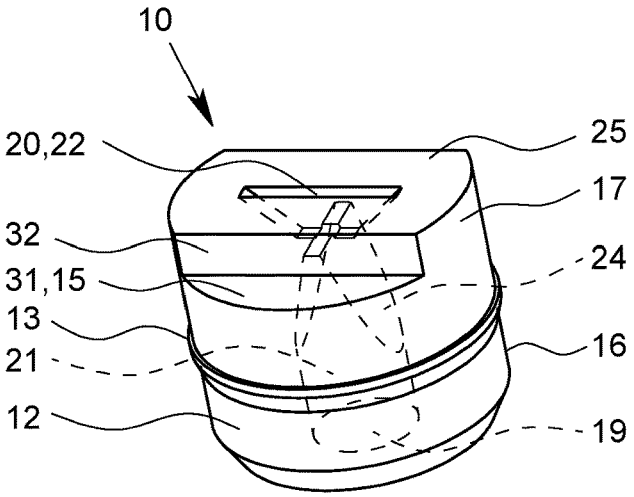
FIG. 6 shows a perspective view of the nozzle arrangement that is rotated by 90° in relation to FIG. 3.
Figure 7:
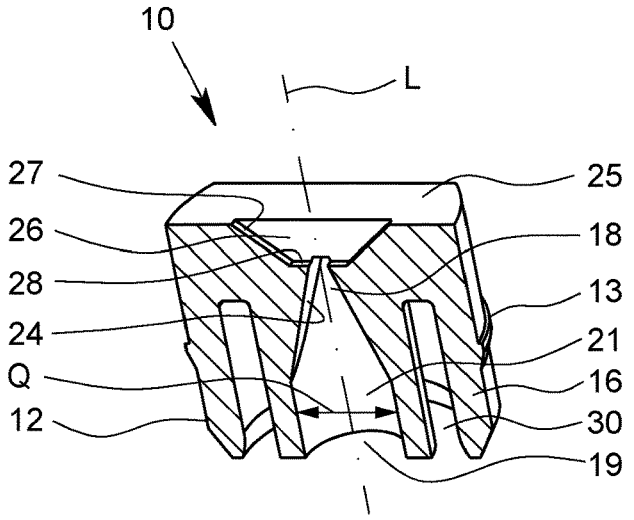
FIG. 7 shows a perspective view of the nozzle arrangement according to FIG. 6 in a longitudinal section.
Figure 9:
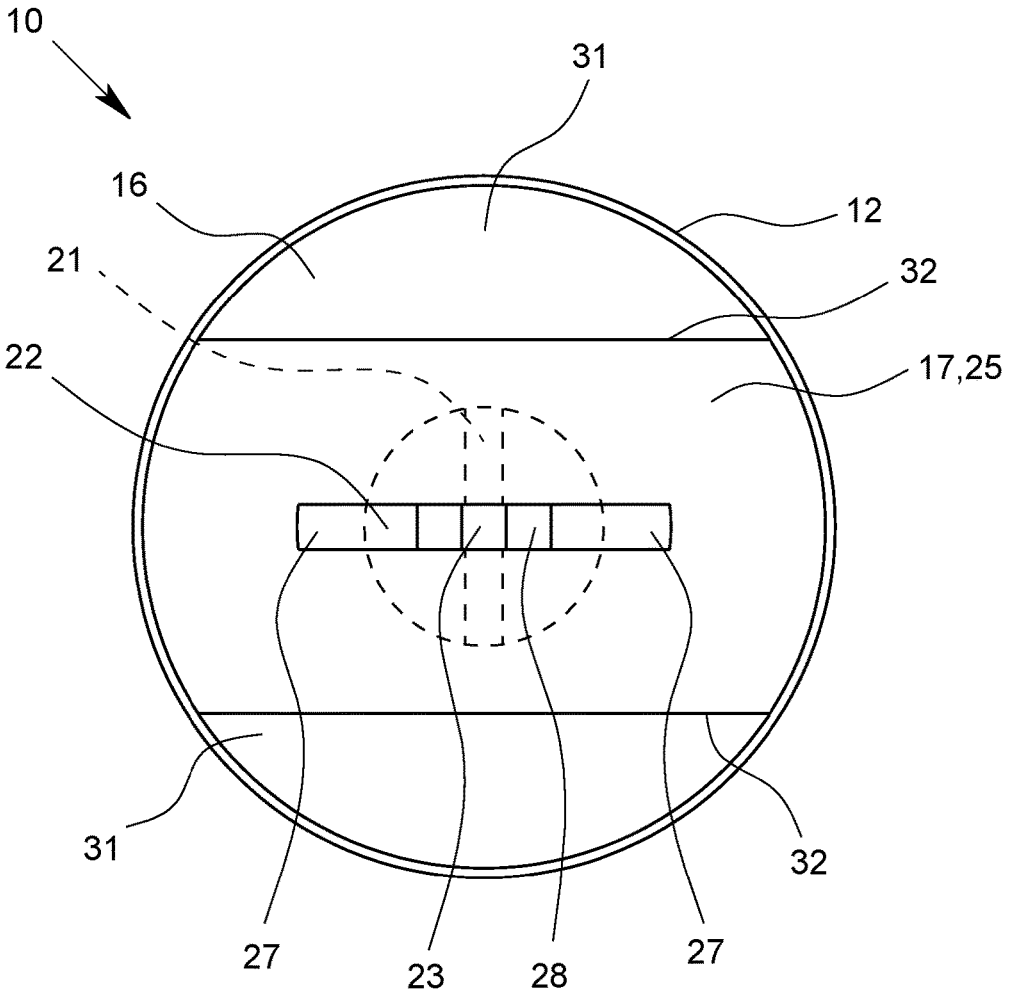
FIG. 9 shows a schematic top view of the nozzle arrangement.

As is shown particularly in FIGS. 3, 6, and 9, the channel portions 21, 22 are preferably arranged so as to be rotated relative to one another, particularly at least substantially by 90°.

Especially preferably, the longitudinal extension of the flow cross section Q of the first channel portion 21 that is the smallest and/or that is adjacent to the second channel portion 22 is arranged so as to be transverse or at least substantially orthogonal to the longitudinal extension of the flow cross section Q of the second channel portion 22 that is the smallest and/or that is adjacent to the first channel portion 21.

In particular, when the nozzle arrangement 10 is viewed from above, the slot-like flow cross sections Q formed by the two channel portions 21, 22 are arranged over one another in the manner of a cross and/or rotated by 90° relative to one another, as is illustrated particularly in FIG. 9.

Preferably, the first channel portion 21 and the second channel portion 22 cut across each other and/or overlap. Especially preferably, the first channel portion 21 extends through the base part 16 into the top part 17.

Figure 8:
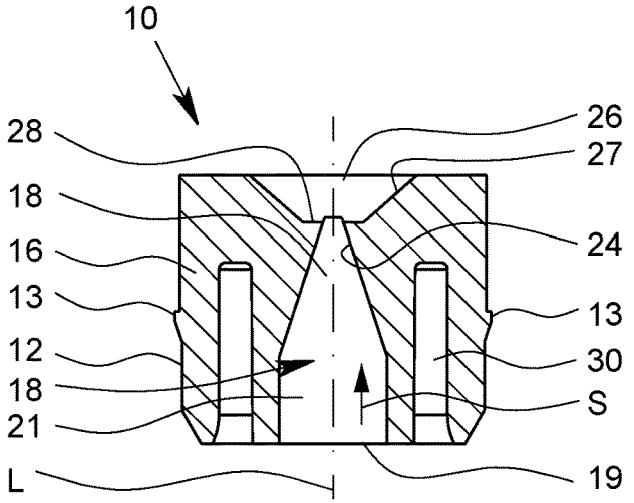
FIG. 8 shows a perspective view of the nozzle arrangement in a longitudinal section that is rotated by 90° in relation to FIG. 5.

In particular, the bottom surface 28 of the second channel portion 22 projects laterally from the side bevels 24 of the first channel portion 21, as shown particularly in FIG. 8.

Preferably, an offset is present between the bottom surface 28 of the second channel portion 22 and the top surface 29 of the first channel portion 21. In particular, the bottom surface 28 or the plane of the second channel portion 22 spanned by the bottom surface 28 is arranged upstream from the top surface 29 or from the plane of the first channel portion 21 spanned by the top surface 29.

Especially preferably, the passage opening 23 extends both transversely and at least substantially parallel to the direction of flow S, and/or the passage opening 23 is (also) embodied in the direction of flow S.

In the depicted embodiment, the nozzle arrangement 10 preferably has a circumferential recess 30, with the recess 30 being preferably arranged in the base part 16. This enables material to be saved during the manufacture of the nozzle arrangement 10.

Preferably, the rotational position of the nozzle arrangement 10 can be aligned during or for the purpose of the mounting of the dispensing device 1 and/or dispensing head 2, preferably such that the aerosol that is produced has the desired orientation or alignment.

Especially preferably, the nozzle arrangement 10 is or can be aligned such that the main plane of propagation of the aerosol produced is arranged transversely and/or at least substantially orthogonal to a longitudinal axis of the dispensing device 1 or the longitudinal axis of the dispensing device 1 runs within or at least substantially parallel to the main plane of propagation of the aerosol produced.

Preferably, the nozzle arrangement 10—preferably in addition to the second channel portion 22—has and/or forms a mounting profile and/or a mounting element 31.

Preferably, the nozzle arrangement 10 can be aligned by means of the mounting profile 31 and a mounting device (not shown), such as a tool, relative to the housing part 6 or actuation part 7.

In particular, the nozzle arrangement 10 is or can be connected to or coupled with a mounting device in a form-fitting manner by means of the mounting profile 31.

Very especially preferably, the nozzle arrangement 10 can be both aligned by means of a mounting device and introduced or inserted into the dispensing device 1 and/or the dispensing head 2, particularly the receptacle 11. The mounting of the dispensing device 1 and/or dispensing head 2 is thus advantageously simplified.

Preferably, the nozzle arrangement 10 and/or the mounting profile 31 has or forms at least one mounting surface 32, with the mounting surface 32 being preferably at least substantially straight and/or flat and/or offsettable or spaced apart from the longitudinal axis L.

Preferably, the nozzle arrangement 10 and/or the mounting profile 31 has or forms several preferably at least substantially parallel mounting surfaces 32.

Preferably, the nozzle arrangement 10 can be grasped and/or rotated on the mounting surface 32. Very especially preferably, a mounting device can be placed on the mounting surface 32, preferably in order to transfer a torque to the nozzle arrangement 10 and/or in order to rotate the nozzle arrangement 10 about the longitudinal axis L.

The mounting profile 31 is preferably arranged and/or formed on the front side and/or on or in the top part 17 of the nozzle arrangement 10.

In the first embodiment (FIGS. 1 to 9), the mounting profile 31 is preferably embodied as a depression or step 15 and/or formed by an (axial) recess in the top part 17 of the nozzle arrangement 10.

Figure 10:
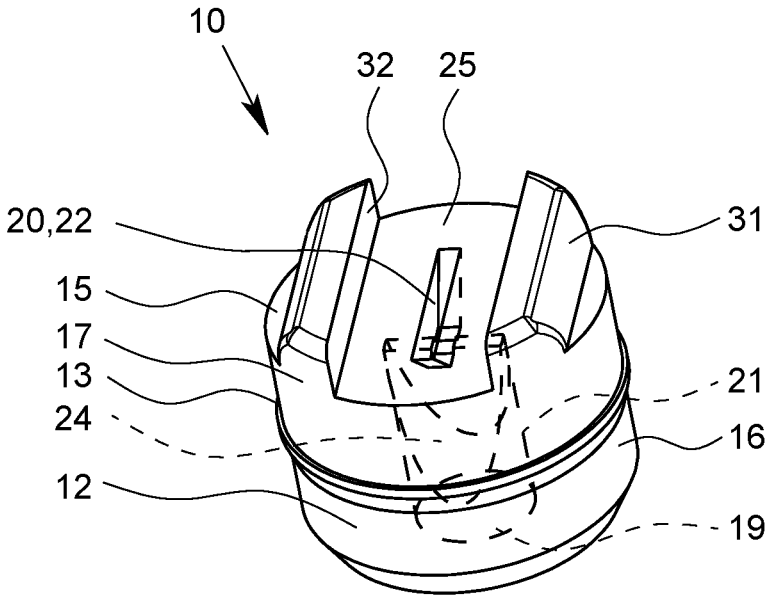
FIG. 10 shows a perspective view of a proposed nozzle arrangement according to a second embodiment.
Figure 11:
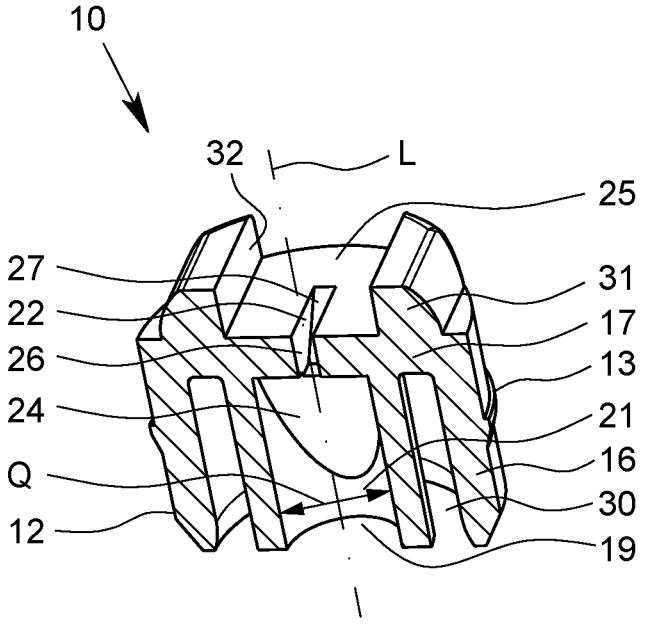
FIG. 11 shows a perspective view of the nozzle arrangement according to FIG. 10 in a longitudinal section.

In addition or alternatively, the mounting profile and/or mounting element 31 is embodied as an (axial) projection or rib, as can be seen in the second embodiment of the nozzle arrangement 10 illustrated in FIGS. 10 and 11.

In the second embodiment, the mounting profile 31 is preferably formed by at least one, here two, preferably axial and/or spaced-apart projections and/or mounting elements 31, particularly on the front side and/or on or in the top part 17.

In particular, the mounting profile 31 is slot-like or embodied as a slot and/or designed to be coupled with a slot-like mounting device.

Preferably, the nozzle arrangement 10 and a mounting device can be connected to or coupled with one another in a preferably form-fitting manner through a relative axial movement or a movement in direction of the longitudinal axis L, preferably such that the mounting device—preferably axially or on the front side—engages in the nozzle arrangement 10 or the mounting profile 31 and/or rests on the mounting surface 32.

The mounting surface 32 or the plane formed by the mounting surface 32 is preferably arranged so as to be at least substantially parallel to and/or spaced apart from the channel 18 and/or second channel portion 22, particularly the side surfaces 26 and/or the planes formed by the side surfaces 26.

Very especially preferably, the channel 18 and/or the second channel portion 22 is arranged between two mounting surfaces 32. This prevents or minimizes an impairment of the spray pattern by the mounting profile 31.

The mounting profile 31 is preferably larger, particularly longer, than the outlet opening 20 or the longitudinal extension of the outlet opening 20.

In particular, the mounting surface 32 or the surface area of the mounting surface 32 is larger than one of the side surfaces 26 or the surface area of one of the side surfaces 26. The handling of the nozzle arrangement 10 during mounting is thus simplified.

Preferably, the mounting profile 31 is formed additionally to and/or independently from the second channel portion 22 in the nozzle arrangement 10. Damaging of the channel 18, particularly the second channel portion 22, during the alignment of the nozzle arrangement 10 is thus advantageously prevented.

In an alternative embodiment (not shown), the channel 18, particularly the second channel portion 22, forms the mounting profile 31, and/or the side surfaces 26 are embodied as mounting surfaces 32.

As explained at the outset, the proposed nozzle arrangement 10 makes it possible to achieve an at least substantially uniform, consistent, symmetrical, fan-like and/or equally wide spray pattern even if the pressure of the fluid 3 or of the container 4 decreases. In particular, the nozzle arrangement 10 reduces flow losses.

Preferably, given a distance between the spray pattern and the nozzle arrangement 10 or outlet opening 20 of at least substantially 150 mm, a temperature of the fluid 3 of at least substantially 21° C., and a viscosity of the fluid 3 of at least substantially 0.82 dPas, a spray pattern (not shown) produced by means of the nozzle arrangement 10 has a width of greater than 160 mm, particularly greater than 170 mm, with a container pressure of at least substantially 1.0 MPa, a width of greater than 140 mm, particularly 150 mm, with a container pressure of at least substantially 0.8 MPa, and a width of greater than 100 mm, particularly 110 mm or 120 mm, with a container pressure of at least substantially 0.6 MPa or 0.4 MPa.

Preferably, the mass of fluid 3 delivered during a predefined period of time is linearly dependent on the pressure of the fluid 3 or of the container 4, at least in the pressure range from 1 MPa to 0.4 MPa.

Preferably, for a dispensing period of 10 seconds, the mass of fluid 3 dispensed is 26 g with a container pressure of 1 MPa, 23 g with a container pressure of 0.8 MPa, 20 g with a container pressure of 0.6 MPa, and 18 g with a container pressure of 0.4 MPa, in particular with the temperature of the fluid 3 being at least substantially 21° C. and the viscosity of the fluid 3 being at least substantially 0.82 dPas.

Individual aspects and features of the invention can be implemented independently of each other or also in any combination with one another.

LIST OF REFERENCE SYMBOLS

| | |
|---|---|
| 1 | dispensing device |
| 2 | dispensing head |
| 3 | fluid |
| 4 | container |
| 5 | dispensing valve |
| 6 | housing part |
| 7 | actuation part |
| 8 | connecting portion |
| 9 | outlet compartment |
| 9A | conveying channel |
| 9B | connecting channel |
| 10 | nozzle arrangement |
| 11 | receptacle |
| 12 | outer surface |
| 13 | projection |
| 14 | recess |
| 15 | step |

-continued

| | |
|---|---|
| 16 | base part |
| 17 | top part |
| 18 | channel |
| 19 | inlet opening |
| 20 | outlet opening |
| 21 | first channel portion |
| 22 | second channel portion |
| 23 | passage opening |
| 24 | side bevel |
| 25 | front surface |
| 26 | side surface |
| 27 | leg surface |
| 28 | bottom surface |
| 29 | top surface |
| 30 | recess |
| 31 | mounting profile |
| 32 | mounting surface |
| L | longitudinal axis |
| S | direction of flow |
| Q | flow cross section |

The invention claimed is:

1. A nozzle arrangement for atomization of a fluid, wherein the nozzle arrangement has a channel for the fluid, wherein the channel has a first channel portion and a second channel portion that connects to the first channel portion in the direction of flow of the fluid, wherein the first channel portion converges in the direction of flow of the fluid, wherein the second channel portion is elongate and/or slot-like in cross section and bordered by two elongate side surfaces and two short leg surfaces, wherein the leg surfaces are inclined relative to the direction of flow or a longitudinal axis of the channel, and/or wherein the second channel portion is embodied as a trapezoidal prism, with the side surfaces being arranged so as to be at least substantially parallel to one another, and wherein a longitudinal extension of a flow cross section of the first channel portion that is the smallest and/or that is adjacent to the second channel portion is transverse to the longitudinal extension of a flow cross section of the second channel portion that is the smallest and/or that is adjacent to the first channel portion.

2. The nozzle arrangement according to claim 1, wherein the leg surfaces are inclined such that the second channel portion diverges in the direction of flow.

3. The nozzle arrangement according to claim 1, wherein the first channel portion tapers in the direction of flow of the fluid in the manner of a slot and/or to an elongate flow cross section.

4. The nozzle arrangement according to claim 1, wherein the first channel portion is fluidically connected via a passage opening to the second channel portion.

5. The nozzle arrangement according to claim 4, wherein the leg surfaces or side surfaces are spaced apart from the passage opening.

6. The nozzle arrangement according to claim 4, wherein the passage opening is rectangular or square, or has the smallest flow cross section in the channel.

7. The nozzle arrangement according to claim 1, wherein the flow cross section abruptly decreases at the end of the first channel portion or abruptly increases in the direction of flow at the beginning of the second channel portion.

8. The nozzle arrangement according to claim 1, wherein the second channel portion directly leads into the open or into a front surface of the nozzle arrangement or is stepless.

9. The nozzle arrangement according to claim 1, wherein the nozzle arrangement is an exchangeable nozzle insert for a dispensing head.

10. The nozzle arrangement according to claim 1, wherein the first channel portion has two side bevels inclined with respect to each other.

11. The nozzle arrangement according to claim 1, wherein the nozzle arrangement is adapted for fan-like atomization of oil as the fluid.

12. A dispensing head for dispensing a fluid, wherein the dispensing head has a housing part, an actuation part for actuating the dispensing head, and a nozzle arrangement for fan-like atomization of the fluid, wherein the dispensing head is connectible or adapted to be connected to an associated container with the fluid, wherein the nozzle arrangement has a channel for the fluid, wherein the channel has a first channel portion and a second channel portion that connects to the first channel portion in the direction of flow of the fluid, wherein the first channel portion converges in the direction of flow of the fluid, wherein the second channel portion is elongate and/or slot-like in cross section and bordered by two elongate side surfaces and two short leg surfaces, wherein the leg surfaces are inclined relative to the direction of flow or a longitudinal axis of the channel, and/or wherein the second channel portion is embodied as a trapezoidal prism, with the side surfaces being arranged so as to be at least substantially parallel to one another, and wherein a longitudinal extension of a flow cross section of the first channel portion that is the smallest and/or that is adjacent to the second channel portion is transverse to the longitudinal extension of a flow cross section of the second channel portion that is the smallest and/or that is adjacent to the first channel portion.

13. The dispensing head according to claim 12, wherein the nozzle arrangement is adapted for fan-like atomization of oil as the fluid.

14. The dispensing head according to claim 12, wherein the nozzle arrangement has a mounting profile for form-fitting coupling with an associated mounting device, with the rotational position of the nozzle arrangement relative to the housing part or actuation part being adjustable by means of the mounting profile.

15. A dispensing device, comprising:

a container for receiving a fluid; and a dispensing head with a nozzle arrangement for atomization of the fluid;

wherein the dispensing head is connectable or connected to the container, wherein the nozzle arrangement has a channel for the fluid, wherein the channel has a first channel portion and a second channel portion that connects to the first channel portion in the direction of flow of the fluid, wherein the first channel portion converges in the direction of flow of the fluid, wherein the second channel portion is elongate and/or slot-like in cross section and bordered by two elongate side surfaces and two short leg surfaces, wherein the leg surfaces are inclined relative to the direction of flow or a longitudinal axis of the channel and/or wherein the second channel portion is embodied as a trapezoidal prism, with the side surfaces being arranged so as to be at least substantially parallel to one another, and wherein a longitudinal extension of a flow cross section of the first channel portion that is the smallest and/or that is adjacent to the second channel portion is transverse to the longitudinal extension of a flow cross section of the second channel portion that is the smallest and/or that is adjacent to the first channel portion.

16. The dispensing device according to claim 15, wherein the nozzle arrangement is adapted for fan-like atomization of the fluid.

17. The dispensing device according to claim 15, wherein the fluid is an oil.

* * * * *